US005133482A

United States Patent [19]

Burrows et al.

[11] Patent Number: 5,133,482

[45] Date of Patent: Jul. 28, 1992

[54] SYRUP DISPENSER VALVE ASSEMBLY

[75] Inventors: Bruce D. Burrows, Valencia; Robert M. Clemens, Newhall, both of Calif.

[73] Assignee: Ebtech, Inc., Columbus, Ohio

[21] Appl. No.: 619,211

[22] Filed: Nov. 28, 1990

[51] Int. Cl.[5] ..... B67D 5/06

[52] U.S. Cl. ..... 222/185; 222/481.5; 222/504

[58] Field of Search ..... 222/129.1-129.4, 222/185, 325, 479, 490, 481.5, 504, 640, 641

[56] References Cited

U.S. PATENT DOCUMENTS

| | | | |
|---|---|---|---|
| 3,193,143 | 7/1965 | Maieli | 222/640 |
| 3,341,073 | 9/1967 | Arps et al. | 222/641 |
| 3,802,606 | 4/1974 | Gust | 222/504 |
| 3,920,149 | 11/1975 | Fortino et al. | 222/129.3 |
| 3,993,218 | 11/1976 | Reichenberger | 222/129.4 |
| 4,124,146 | 11/1978 | Sealfon | 222/641 |
| 4,722,463 | 2/1988 | Anderson | 222/185 |
| 4,793,514 | 12/1988 | Sheets | 222/481.5 |
| 4,898,308 | 2/1990 | Rudick | 222/504 |

*Primary Examiner*—Michael S. Huppert
*Assistant Examiner*—Philippe Derakshani
*Attorney, Agent, or Firm*—Kelly Bauersfeld & Lowry

[57] ABSTRACT

An improved valve assembly is provided for use in dispensing liquids, particularly such as flavored syrup and the like in a soft drink dispenser station. The valve assembly comprises a compact unit adapted to mount directly into the neck of a bottle containing a flavor syrup, wherein the bottle is designed for inverted installation into the dispenser station with the neck seated within a mating support socket. The valve assembly includes parallel dispense and vent ports, together with a dispense valve for regulating syrup outflow and a check valve for permitting air inflow. The dispense valve comprises the armature of a solenoid actuator, the coil of which is integrated with the support socket and adapted for connection to an electrical current for displacing the dispense valve to an open position and thereby permit gravity syrup flow from the bottle. The dispensed syrup volume is replaced by air drawn into the bottle through the vent port and an associated vent tube which projects a short distance into the bottle interior. The check valve, such as a duckbill type check valve, is mounted on the vent tube to permit low resistance air inflow into the bottle while preventing syrup backflow through the vent tube. The check valve is positioned a short distance above the dispense port such that syrup dispensing occurs under the influence of a relatively small and substantially constant pressure head.

16 Claims, 3 Drawing Sheets

FIG. 1
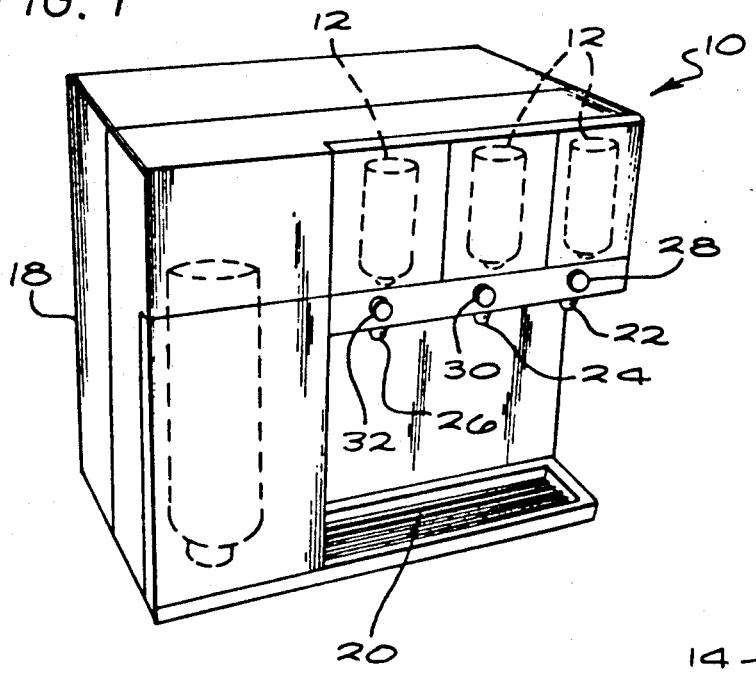
FIG. 2
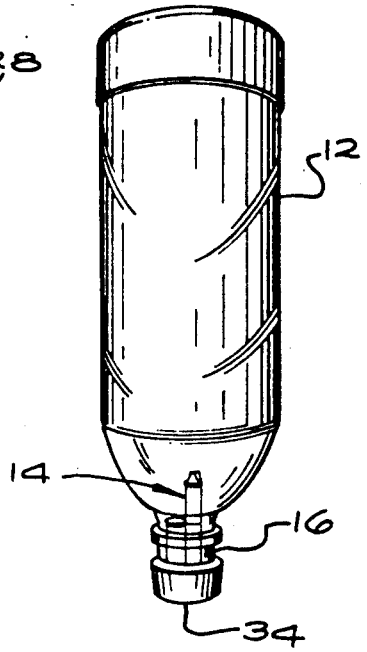
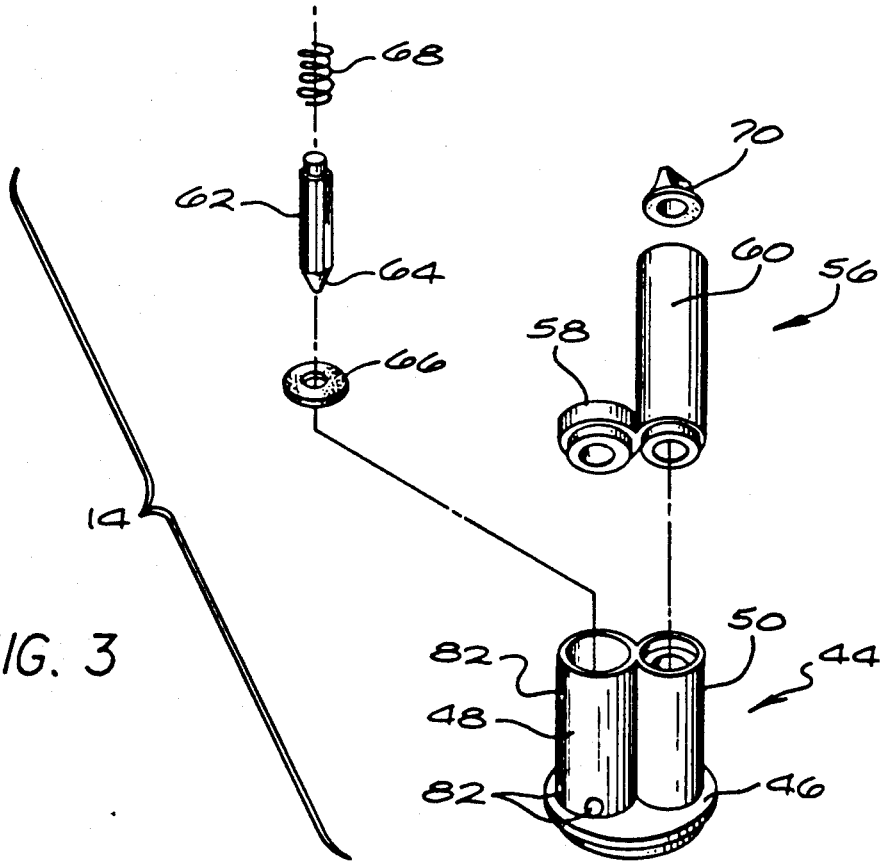
FIG. 3

FIG. 4
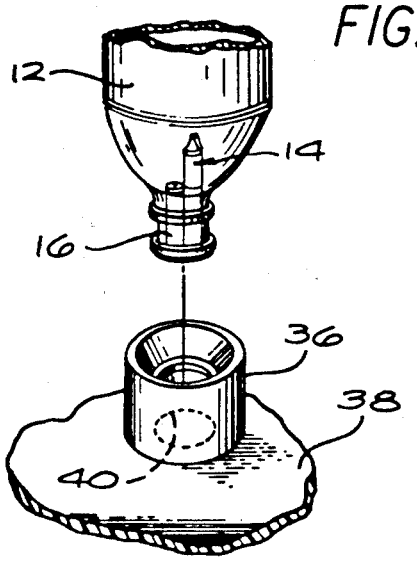
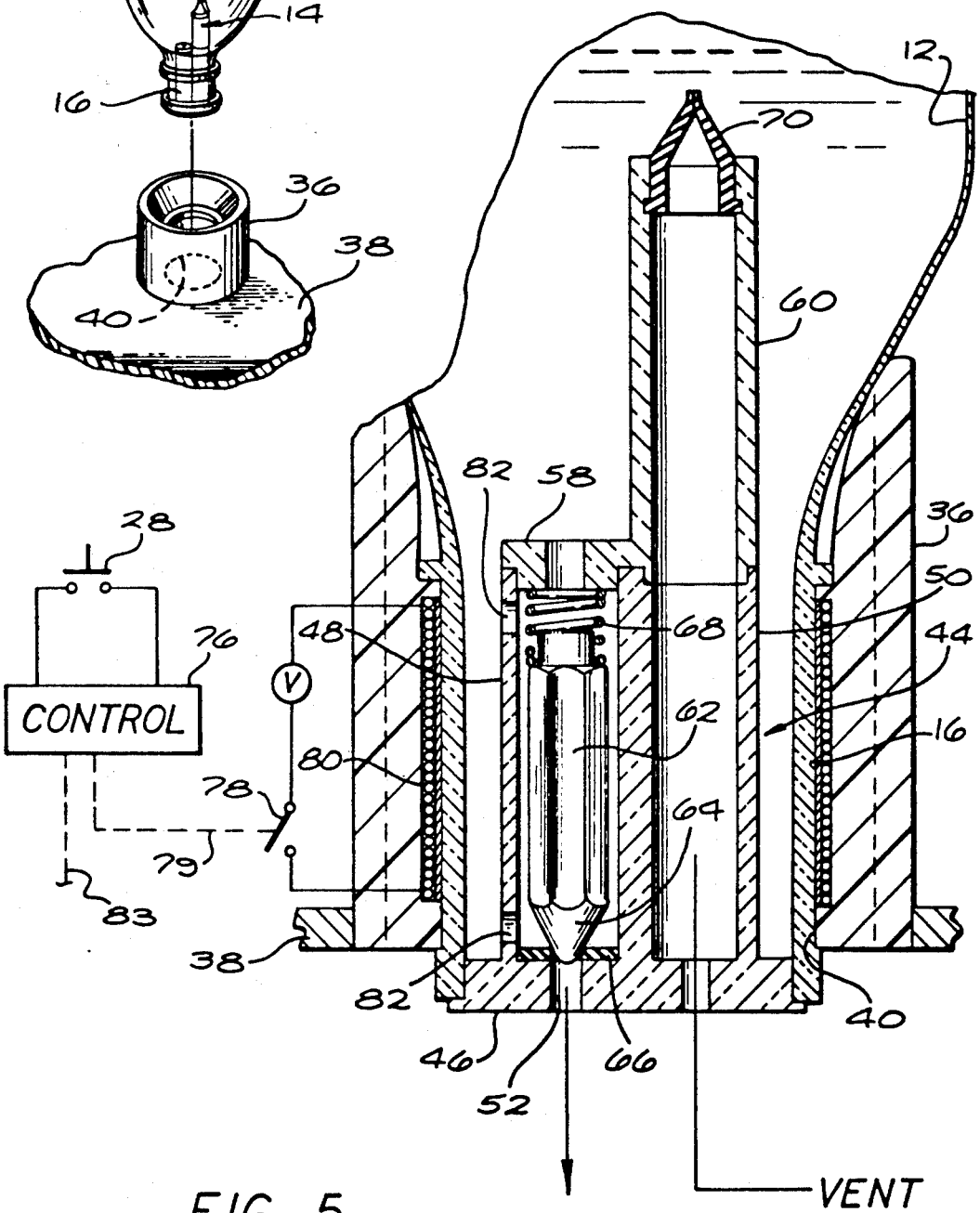
FIG. 5

SYRUP DISPENSER VALVE ASSEMBLY

BACKGROUND OF THE INVENTION

This invention relates generally to dispensing valves for use in regulated dispensing of liquids, particularly such as dispensing of flavor syrups and the like used in soft drink dispenser stations for mixing and dispensing soft drink beverages. More specifically, this invention relates to an improved yet compact and simplified valve assembly adapted for installation directly into the neck of a bottle containing a flavor syrup or the like, wherein the valve assembly is designed for relatively simple controlled operation to dispense accurate quantities of the syrup.

Soft drink dispenser stations and/or vending machines and the like are generally known in the art for use in dispensing soft drink beverages in individual servings, typically on the order of about 6–10 ounces per serving. Such dispenser stations commonly include a water reservoir adapted to receive and store a supply of fresh water typically in carbonated form, together with one or more separate bottles containing flavor syrup. When a beverage serving is desired, the dispenser station regulates the flow of proportional quantities of the chilled water and the selected flavor syrup for mixture and dispensing into a drinking cup, glass, etc. Since the flavor syrup is normally provided in concentrated form, a relatively small volumetric proportion of the flavor syrup is delivered for each serving, in comparison with a significantly larger volumetric quantity of the chilled water. Accordingly, accurate delivery of closely regulated or metered volumes of the flavor syrup is extremely important to insure dispensing of a consistent and high quality beverage product to the consumer. Relatively minor variations in the dispensed syrup quantity can unfortunately result in significant fluctuations in the taste of the final beverage.

In the past, soft drink flavor syrups have been provided in containers of various sizes and shapes adapted for association with valve apparatus through which the flavor syrup is dispensed. For example, in one common form, relatively sturdy syrup containers in the form of metal canisters or the like have been connected to a positive pressure gas adapted to deliver the syrup through metering valves under relatively constant pressure conditions. However, such syrup containers are relatively costly and are not adapted for economic disposal when empty. Moreover, the associated pressurizing gas and related flow conduits and valve mechanisms are relatively complex in construction to result in a relatively costly dispenser station.

More recently, disposable syrup containers in the form of lightweight plastic bottles have been proposed for gravity feed dispensing of flavor syrup. Such gravity feed bottles are normally installed in an inverted position with the bottle neck seated in a support socket having regulatory valve apparatus integrated therein. In some designs, the interior of the inverted syrup bottle is vented to atmosphere, such that gravity dispensing of syrup may occur under constant and/or relatively low pressure head conditions. However, the valve apparatus has continued to require a variety of moving parts in combination with relatively complex operating structures, resulting again in a relatively costly dispenser station construction. Moreover, the valve apparatus has included moving valve components which are contacted by the flavor syrup, whereby syrup residue can accumulate to result in an unsanitary condition or otherwise result in eventual valve malfunction.

The present invention provides an improved dispenser valve assembly for use with gravity feed syrup bottles and the like, wherein the valve assembly has a highly compact geometry adapted for mounting directly into the bottle neck, and further wherein moving valve components and related mechanical actuator devices are not required at the bottle support socket on the dispenser station. Moreover, the present invention provides a simplified and easily operated valve assembly which, if desired, may be economically discarded with the syrup bottle when the syrup supply therein is exhausted.

SUMMARY OF THE INVENTION

In accordance with the invention, an improved dispenser valve assembly is provided for use in controlled dispensing of liquids from a container, such as dispensing of precision quantities of flavor syrup of the type used in soft drink dispenser stations. The improved dispenser valve assembly is adapted for mounting directly into a syrup-containing bottle, such as directly within the bottle neck, and includes means for regulating syrup dispensing in a precision controlled manner under the influence of a constant low pressure fluid head.

The dispenser valve assembly of the present invention is particularly adapted for use with relatively compact bottles or containers filled with concentrated flavor syrup for use in a soft drink dispenser station for mixing and dispensing soft drink beverages. In such dispenser stations, regulated quantities of the flavor syrup are dispensed from the syrup-containing bottle for mixture with a proportional quantity of chilled and typically carbonated water to produce a pleasing soft drink beverage.

In the preferred form, the improved valve assembly has a compact size and shape for installation directly into the neck of the syrup-containing bottle in a manner which does not interfere with mounting of a conventional bottle cap to maintain the bottle contents in a clean and sanitary condition. When the bottle is used, the cap is removed and the bottle is inverted for seated placement of the bottle neck into a mating support socket forming a portion of the dispenser station. The valve assembly maintains the bottle in a substantially closed condition, substantially without fluid leakage, during neck placement into the station support socket.

The valve assembly defines a dispense port for discharge flow of the syrup into an underlying receptacle, such as a drinking cup. A movable valve member forms a portion of the valve assembly and is positioned for normally closing the dispense port by gravity when the bottle is inverted and/or by means of a biasing spring for normally preventing syrup discharge. A vent tube disposed generally adjacent to and extending in parallel with the valve member projects from the vent port for a short distance into the interior of the syrup-containing bottle.

The valve member of the syrup dispenser valve assembly is formed from a material movably responsive to a magnetic field, to provide an armature of a solenoid actuator. A solenoid actuator coil is carried within the station support socket to surround the valve member when the syrup-containing bottle is supported within the socket. Control means are provided for connection of an electrical current to the solenoid coil for retracting the valve member to an open position spaced above the dispense port, thereby permitting gravity syrup dispensing through the dispense port. During such dispensing, a check valve such as a duckbill type valve on the vent tube permits relatively low resistance inflow of air into the bottle to replace the dispensed liquid volume. The vertical height between the dispense port and the check valve is fixed and relatively small, such that gravity syrup dispensing is subject to a relatively small and substantially constant fluid pressure head, resulting in substantially constant dispense volumes for a fixed time interval.

Other features and advantages of the invention will become more apparent from the following detailed description, taken in conjunction with the accompanying drawings which illustrate, by way of example, principles of the invention.

BRIEF DESCRIPTION OF THE DRAWINGS

The accompanying drawings illustrate the invention. In such drawings:

FIG. 1 is a front perspective view of a soft drink dispenser station adapted for use with flavor syrup bottles equipped with the improved dispenser valve assembly embodying the novel features of the invention;

FIG. 2 is a perspective view depicting one of the syrup bottles having the improved dispenser valve assembly mounted therein;

FIG. 3 is an enlarged perspective view illustrating construction details of the valve assembly;

FIG. 4 is a fragmented exploded perspective view showing engagement of a flavor syrup container with a mating support socket forming a portion of the soft drink dispenser station;

FIG. 5 is an enlarged fragmented vertical sectional view, depicted partially in schematic form, showing the dispenser valve assembly seated within the support socket and disposed in a closed condition to prevent syrup flow therethrough.

DETAILED DESCRIPTION OF THE PREFERRED EMBODIMENT

Figure 6:
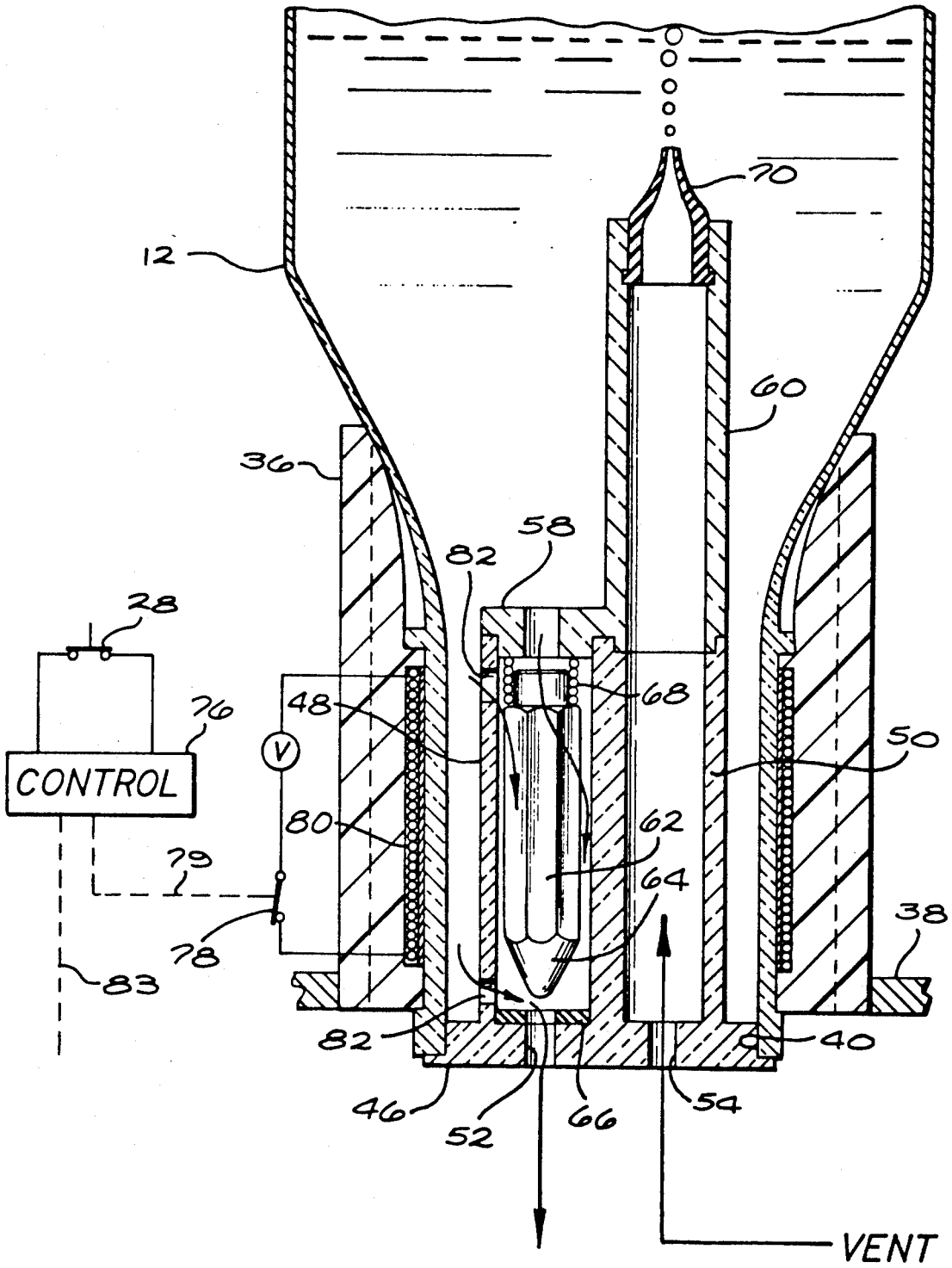
FIG. 6 is an enlarged fragmented vertical sectional view similar to FIG. 5 but showing the dispenser valve assembly in an open condition to permit syrup flow therethrough.

As shown in the exemplary drawings, a soft drink dispenser station referred to generally in FIG. 1 by the reference numeral 10 includes one or more relatively small bottles 12 containing flavor syrup used in making soft drink beverages. As shown in FIGS. 2 and 3, each of the syrup-containing bottles 12 includes a relatively compact dispenser valve assembly 14 mounted directly into the bottle neck 16, wherein the valve assembly 14 is designed for closely and accurately regulating syrup dispensing flow from the bottle 12 during normal operation of the dispenser station.

More particularly, the illustrative soft drink dispenser station 10 is constructed generally in a manner known in the art to include a station housing 18 which may be sized and shaped for a convenient and compact countertop installation. The exemplary housing 18 defines a forwardly open receptacle 20 for receiving a drinking cup (not shown) or the like in a filling position disposed immediately below any one of three separate dispensing nozzles 22, 24 and 26. These nozzles 22, 24 and 26 are respectively associated with a corresponding number of the syrup-containing bottles 12 adapted for removable mounting within the station housing 18. In addition, the dispensing nozzles are further associated with individual dispense actuators such as the illustrative dispense buttons 28, 30 and 32. Depression of one of the dispense buttons 28, 30 and 32 initiates station operation in a manner delivering and mixing proportionate quantities of the flavor syrup from the selected associated bottle 12 and chilled water, typically carbonated, from a water reservoir (not shown) within the station housing. For a further and more detailed discussion of soft drink dispenser stations of this general type, see copending application Ser. No. 562,244 now U.S. Pat. No. 5,071,595, which is incorporated by reference herein. Moreover, although the illustrative drawings show a countertop size dispenser station 10 and relatively small volume syrup-containing bottles, it will be understood that the invention is equally applicable to dispenser stations and other fluid containers and related dispense apparatus of various size and type.

The improved syrup dispenser valve assembly 14 of the present invention is mounted directly into the neck 16 of the associated syrup-containing bottle 12, subsequent to bottle filling with syrup or the like of selected flavor. Importantly, the valve assembly 14 has a relatively compact and simple construction adapted for economical manufacture predominantly from lightweight molded plastic components or the like, and to fit relatively easily into the neck 16 of a conventional blow-molded or otherwise suitably formed plastic or glass bottle of selected volumetric capacity. Moreover, the valve assembly 14 accommodates mounting of a conventional bottle cap 34 onto the bottle neck, with the cap 34 maintaining the syrup contents and the installed valve assembly in a clean and sanitary condition prior to usage.

When one of the syrup-containing bottles 12 of the dispenser station 10 (FIG. 1) reaches an empty condition, a filled replacement bottle including the improved valve assembly 14 can be installed quickly and easily. That is, the empty bottle 12 can be removed from the station 10 and replaced by the filled bottle 12 including the valve assembly 14. In this regard, the station 10 includes a generally cylindrical or sleeve-shaped support socket 36 (FIGS. 4–6) projecting upwardly from a platform 38 forming a portion of the station housing 18. The support socket 36 defines an annular seat adapted for drop-in reception of the bottle neck 16 with the bottle 12 inverted (FIG. 4), with an opening 40 in the socket 36 permitting bottle communication with the underlying receptacle 20.

As shown best in FIGS. 3 and 5, the valve assembly 14 comprises a base member 44 having a generally circular cap plate 46 sized for relatively snug-fit mounting at the open end of the bottle neck 16. A pair of generally parallel cylinders 48 and 50 project from the internal or inboard side of the cap plate 46 with a length substantially spanning the cylindrical bottle neck 16. These two cylinders 48 and 50 are aligned with relatively small ports 52 and 54 (FIG. 3) formed in the cap plate 46 and thus communicating via said ports with the exterior of the bottle and the underlying receptacle 20. As will be described in more detail, the port 52 comprises a dispense port for syrup discharge flow from the bottle, and the port 54 comprises a vent port for permitting air inflow into the bottle.

A tubular extension member 56 is also provided as part of the dispenser valve assembly and includes a end fitting 58 for seated reception onto the inner or inboard end of the cylinder 48. In addition, the extension member 56 includes a cylindrical extension segment 60 adapted for in-line mounting at the inner or inboard end of the second cylinder 50.

Prior to mounting of the extension member 56 onto the base member 44, a pin-shaped valve head 62 of a suitable ferromagnetic or other similar magnetically attractable material such as stainless steel or the like is positioned within the cylinder 48. A conical nose 64 on the valve head 62 engages an annular resilient seal washer 66 at the inboard side of the associated port 52. Moreover, in the preferred form, a compression spring 68 is provided to react between the subsequently mounted end fitting 58 and the valve head 62 for normally urging the valve head nose 64 into engagement with the washer 66 for closing and sealing the port 52. Accordingly, the cylinder 48 with valve head 62 installed therein comprises a syrup dispense tube through which syrup within the bottle 12 may flow in a regulated manner for discharge passage through the dispense port 52. The valve head 62 is normally closed to prevent such syrup discharge, for example, during placement of the bottle neck 16 into the support socket 36 and thereafter until syrup dispensing is desired.

The cylindrical extension segment 60 of the extension member 56 cooperates with the second cylinder 50 of the base member 44 to define a vent tube extending from the cap plate 46 and the vent port 54 therein for a short distance into the bottle interior. In the preferred form, the length of this vent tube is relatively short in relation to overall bottle height, but significantly taller than the adjacent dispense tube or cylinder 48. A check valve 70 such as a duckbill type valve of resilient elastomer material is mounted at the innermost or inboard end of the vent tube to prevent syrup discharge through the vent port 54, while permitting air inflow into the bottle 12 with little or no flow resistance.

When dispensing of a selected syrup volumetric quantity is desired, depression of the dispense button 28, 30 or 32 associated with the specific syrup-containing bottle 12 operates station control apparatus 76 (FIGS. 5 and 6) to dispense and mix the syrup and water. In particular, with respect to the flavor syrup as viewed FIG. 5, the control apparatus 76 signals a switch 78 via a control line 79 to apply a voltage across a conductive winding or coil 80 integrated into the cylindrical support socket 36. As a result, an electrical current passes through the coil 80 for electromagnetically retracting the valve head 62 to an open position, as viewed in FIG. 6. The thus-opened valve head 62 permits gravity flow of the flavor syrup through flow ports 82 formed at various positions about the dispense tube, and further through the dispense port 52 into an underlying drinking cup or the like. During such dispensing of the syrup, the volume within the bottle occupied previously by dispensed syrup is replaced in a substantially instantaneous manner by air drawn through the vent tube and associated check valve 70. Importantly, the relatively short vertical spacing between the dispense port 52 and the check valve 70 provides a constant low pressure fluid head at the discharge port 52. With this arrangement, opening of the valve member 62 for a fixed timed interval during each dispensing cycle provides dispensing of highly uniform quantities of the flavor syrup. Alternately, the control 76 can be designed to open the valve member 62 for a variable time period corresponding with the time of depression of the associated dispense button. In either case, the dispensed syrup is mixed in any suitable manner known in the art with water dispensed separately in response to a signal via a separate control line 83.

When the bottle 12 reaches a substantially emptied condition, the bottle with valve assembly 14 therein can be removed as a unit for disposal. In this regard, the preferred form of the invention mounts the valve assembly 14 securely into the bottle neck 16 by means of a ultrasonic weld or the like. Alternatively, if desired, the valve assembly 14 can be designed for manual removal from an empty bottle 12 and simple press-fit installation into a fresh bottle if valve assembly re-use is desired. In either case, except for the coil 80, all of the flow path and valve components used to regulate syrup dispensing are contained wholly within the bottle in a compact and simple mechanical arrangement.

A variety of modifications and improvements to the improved dispenser valve assembly 14 of the present invention will be apparent to those skilled in the art. As one example, various types of syrup container may be used with the valve assembly 14 installed therein. Accordingly, no limitation on the invention is intended by way of the foregoing description and accompanying drawings, except as set forth in the appended claims.

What is claimed is:

1. A dispenser valve assembly for mounting within the neck of a bottle, said valve assembly comprising:

a cap plate having a size and shape for mounting across the neck of a bottle, said cap plate having a dispense port and a vent port formed therein;

a valve member for respectively opening and closing said dispense port;

means for movably mounting said valve member at one side of said cap plate in a position within said bottle for movement between a first position closing said dispense port and second position opening said dispense port to permit flow of liquid from within said bottle through said dispense port to the exterior of said bottle;

a vent tube having one end connected to said cap plate in flow communication with said vent port, said vent tube projecting from said one side of said cap plate into the bottle when said cap plate is mounted across the bottle neck; and check means associated with said vent tube for preventing flow of liquid from within the bottle through said vent port and for permitting flow of air into the bottle through said vent port when said cap plate is mounted across the bottle neck;

said valve member being formed from a magnetically attractable material, said valve member defining an armature of a solenoid actuator, said solenoid actuator further including a coil disposed outside the neck of the bottle, and further including means for connected said coil to an electrical current for electromagnetically displacing said valve member relative to said dispense port.

2. The dispenser valve assembly of claim 1 wherein said cap plate and said vent tube are formed as a plastic molding.

3. The dispenser valve assembly of claim 1 wherein said check means comprises a check valve mounted on said vent tube at a selected and relatively short vertical spacing with respect to said dispense port.

4. The dispenser valve assembly of claim 1 wherein said check valve comprises a duckbill valve.

5. The dispenser valve assembly of claim 1 wherein said means for mounting said valve member comprises a dispense tube having one end connected to said one side of said cap plate in flow communication with said dispense port, said dispense tube projecting from said cap plate into the bottle and defining at least one flow port communicating the interior of said dispense tube with the interior of the bottle when said cap plate is mounted across the bottle neck.

6. The dispenser valve assembly of claim 1 wherein said valve member normally closes said dispense port.

7. The dispenser valve assembly of claim 6 further including spring means for urging said valve member toward a normal position closing said dispense port.

8. In combination:

a bottle adapted for receiving and storing a quantity of a selected liquid, said bottle having an opening;

a dispenser station including a generally cylindrical and upwardly open support socket for receiving and supporting said bottle in an inverted position with said bottle opening presented downwardly;

a dispenser valve assembly comprising a cap plate mounted generally to extend across said bottle opening and having a dispense port and a vent port formed therein a valve member for respectively opening and closing said dispense port, means for movably mounting said valve member at one side of said cap plate in a position within said bottle for movement between a first position closing said dispense port and second position opening said dispense port to permit flow of liquid from within said bottle through said dispense port to the exterior of said bottle, a vent tube having one end connected to said one side of said cap plate in flow communication with said vent port and projecting from said cap plate into the bottle, and check means on said vent tube for preventing flow of liquid from within the bottle through said vent port and for permitting flow of air into the bottle through said vent port when said cap plate is mounted across the bottle neck; and means for controllably displacing said valve member to open and close said dispense port;

said valve member being formed from a magnetically attractable material, said means for displacing said valve member comprising a solenoid actuator coil mounted on said support socket in a position for generally surrounding said valve member when said bottle is supported by said socket, and means for connecting said coil to an electrical current for electromagnetically displacing said valve member relative to said dispense port.

9. The combination of claim 8 wherein said bottle has a neck, said valve assembly being positioned substantially within said bottle neck.

10. The combination of claim 8 further including removable cap means for closing said bottle opening, said cap means being removably mounted on said bottle over said valve assembly.

11. The combination of claim 8 wherein said valve member normally closes said dispense port.

12. The combination of claim 11 further including spring means for urging said valve member toward a normal position closing said dispense port.

13. The combination of claim 8 wherein said check means comprises a check valve mounted on said vent tube at a selected and relatively short vertical spacing with respect to said dispense port.

14. The combination of claim 13 wherein said check valve comprises a duckbill valve.

15. A dispenser valve assembly for mounting within the neck of a bottle, said valve assembly comprising:

a cap plate having a size and shape for mounting across the neck of a bottle, said cap plate having a dispense port and a vent port formed therein;

a vent tube connected to said cap plate in flow communication with said vent port and projecting from said cap plate into the bottle when said cap plate is mounted across the bottle neck;

a solenoid armature valve member;

means for mounting said valve member at one side of said cap plate and at a position within the bottle when said cap plate is mounted across the bottle neck, said valve member being mounted relative to said dispense port for movement between positions respectively opening and closing said dispense port; and check means associated with said vent tube for preventing flow of liquid within the bottle through said vent port and for permitting flow of air into the bottle through said vent port when said cap plate is mounted across the bottle neck.

16. The dispenser valve assembly of claim 15 further including a coil disposed outside the neck of the bottle, and further including means for connecting said coil to an electrical current for electromagnetically displacing said valve member relative to said dispense port.

* * * * *